US005198129A

United States Patent [19]

Hata

[11] Patent Number: 5,198,129

[45] Date of Patent: Mar. 30, 1993

[54] LUBRICATING OIL COMPOSITION CONTAINING ZINC DITHIOPHOSPHATE

[75] Inventor: Hitoshi Hata, Ichihara, Japan

[73] Assignee: Idemitsu Kosan Co., Ltd., Tokyo, Japan

[21] Appl. No.: 707,982

[22] Filed: May 21, 1991

Related U.S. Application Data

[63] Continuation of Ser. No. 542,434, Jun. 22, 1990, abandoned.

[30] Foreign Application Priority Data

Jul. 13, 1989 [JP] Japan ..... 1-178937

[51] Int. Cl.[5] ..... C10M 105/04

[52] U.S. Cl. ..... 252/32.7 E; 252/52 R; 252/56 D; 252/32.7 HC

[58] Field of Search ..... 252/32.7 E, 32.7 HC, 252/52 R, 56 D

[56] References Cited

U.S. PATENT DOCUMENTS

| | | | |
|---|---|---|---|
| 2,418,894 | 4/1947 | McNab et al. . | |
| 2,945,810 | 7/1960 | Walker . | |
| 3,679,585 | 7/1972 | Brook et al. . | |
| 3,729,417 | 4/1973 | Hashimoto et al. | 252/32.7 HC |
| 4,298,483 | 11/1981 | Davis et al. | 252/32.7 HC |
| 4,383,931 | 5/1983 | Ryu et al. | 252/32.7 HC |
| 4,634,541 | 1/1987 | Caspari et al. | 252/32.7 E |
| 4,867,890 | 9/1989 | Colclouph et al. | 252/32.7 E |

FOREIGN PATENT DOCUMENTS

| | | |
|---|---|---|
| 0113045 | 7/1984 | European Pat. Off. . |
| 0280260 | 8/1988 | European Pat. Off. . |
| 0286996 | 10/1988 | European Pat. Off. . |
| 0291006 | 11/1988 | European Pat. Off. . |
| 1956638 | 7/1970 | Fed. Rep. of Germany . |
| 60-248796 | 12/1985 | Japan . |

*Primary Examiner*—Olik Chaudhuri
*Assistant Examiner*—M. Nuzzolillo
*Attorney, Agent, or Firm*—Frishauf, Holtz, Goodman & Woodward

[57] ABSTRACT

A lubricating oil composition comprising a major amount of at least one lubricating base oil, from 0.05 to 5% by weight of at least one zinc dithiophosphate, and from 0.01 to 10% by weight of at least one unsaturated aliphatic alcohol of from 16 to 24 carbon atoms, the weight ratio of the unsaturated aliphatic alcohol to the zinc dithiophosphate being from 0.1 to 10, has excellent thermostability and oxidation stability and has an excellent effect in improving load carrying capacity and wear resistance.

21 Claims, No Drawings

LUBRICATING OIL COMPOSITION CONTAINING ZINC DITHIOPHOSPHATE

CONTINUING DATA

This application is a continuation, of application Ser. No. 07/542,434, filed Jun. 22, 1990 now abandoned.

BACKGROUND OF THE INVENTION

1. Field of the Invention

The present invention relates to a lubricating oil composition which can be suitably used as hydraulic fluid, traction fluid, bearing oil, gear oil, engine oil, etc.

2. Description of the Related Art

Zinc dithiophosphates have been widely used in lubricating oils having requirements for the function of improving wear resistance and load carrying capacity, thermostability, and oxidation stability.

Recently, as the service environment of these lubricating oils has become severe, there has arisen a demand particularly for lubricating oils having such high thermostability and oxidation stability as to withstand use at high temperature.

As a means of improving thermostability and oxidation stability, in Japanese Patent Application Kokai Koho (Laid-open) No. 60-248796 proposed is adding zinc dithiophosphates into lubricating base oils together with other additives including nitrogen-containing copolymers, metallic detergent-dispersants, ashless detergent-dispersants, etc. However, such additives decrease load carrying capacity and wear resistance and cannot bring about sufficient increase in thermostability and oxidation stability, and therefore, the obtained lubricating oil cannot be prevented sufficiently from formation of sludge and coloration and discoloration.

SUMMARY OF THE INVENTION

The present invention has been made under the above-described circumstances, and the object of the present invention is to provide a lubricating oil composition which has not only excellent effect in improving load carrying capacity and wear resistance but also excellent thermostability and oxidation stability whereby formation of sludge and coloration and discoloration are inhibited and heat degradation and oxidation degradation can be retarded.

We have made a diligent study with respect to dissolving the above-described problems and have found that a lubricating oil composition satisfying the above-described object is obtainable by blending unsaturated aliphatic alcohols of from 16 to 24 carbon atoms together with zinc dithiophosphates into lubricating base oils in a specific ratio, and on the basis of the finding, we have eventually completed the prevent invention.

That is, the present invention provides a lubricating oil composition, comprising:

(A) a major amount of at least one lubricating base oil;

(B) from 0.05 to 5% by weight of at least one zinc dithiophosphate having a structure represented by the following general formula (1)

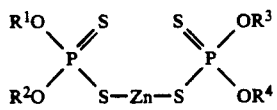

(1)

wherein each of $R^1$, $R^2$, $R^3$, and $R^4$ is independently a primary alkyl group of from 2 to 30 carbon atoms, a secondary alkyl group of from 3 to 30 carbon atoms, a cycloalkyl group of from 6 to 30 carbon atoms, an aryl group of from 6 to 14 carbon atoms or an alkylaryl group of from 7 to 30 carbon atoms; and (C) from 0.01 to 10% by weight of at least one unsaturated aliphatic alcohol of from 16 to 24 carbon atoms, wherein the weight ratio of the unsaturated aliphatic alcohol to the zinc dithiophosphate, (C)/(B), is from 0.1 to 10.

The oxidation stability of the lubricating oil composition of the present invention can be further improved by adding detergent-dispersants. That is, the present invention also provides a lubricating oil composition, comprising:

(A) a major amount of at least one lubricating base oil;

(B) from 0.05 to 5% by weight of at least one zinc dithiophosphate having a structure represented by the following general formula (1)

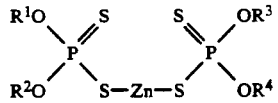

(1)

wherein $R^1$, $R^2$, $R^3$, and $R^4$ are as defined above;

(C) from 0.01 to 10% by weight of at least one unsaturated aliphatic alcohol of from 16 to 24 carbon atoms; and (D) a relatively small amount of at least one detergent-dispersant, wherein the weight ratio of the unsaturated aliphatic alcohol to the zinc dithiophosphate, (C)/(B), is from 0.1 to 10.

The lubricating oil composition of the present invention can be suitably used as hydraulic fluid, traction fluid, bearing oil, gear oil, engine oil, etc. even in sever circumstances where exposure to high temperature is inevitable.

THE PREFERRED EMBODIMENTS OF THE INVENTION

The component (A), i.e. the lubricating base oil to be used in the lubricating oil composition of the present invention may be any one generally used in lubricating oils and is not particularly limited. Generally, a mineral oil or a synthetic oil each having a kinematic viscosity of from 5 to 10,000 cSt as measured at 40° C. may be used.

The mineral oil is not particularly limited so far as it satisfies the above-described condition, and some examples include those obtained by refining lubricating oil fraction of petroleum by means of solvent refining, hydrorefining, clay treatment, or a combination thereof and highly aromatic fractions obtained by solvent refining of lubricating oils, or hydrides of the highly aromatic fractions. Some examples of the synthetic oil include alkyl-substituted aromatic compounds, poly-α-olefin oils, ester oils, diester oils, hindered ester oils, synthetic naphthene oils, polyglycol oils, and mixtures thereof.

The zinc dithiophosphate (ZnDTP) to be used as the component (B) in the lubricating oil composition of the present invention is the compound represented by the following general formula (I)

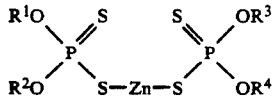

(I)

wherein each of $R^1$, $R^2$, $R^3$, and $R^4$ is independently a primary alkyl group of from 2 to 30 carbon atoms, preferably from 3 to 12 carbon atoms, a secondary alkyl group of from 3 to 30 carbon atoms, preferably from 3 to 12 carbon atoms, a cycloalkyl group of from 6 to 30 carbon atoms, an aryl group of from 6 to 14 carbon atoms or an alkylaryl group of from 7 to 30 carbon atoms, preferably from 9 to 24 carbon atoms.

Some examples of the zinc dithiophosphate include
zinc dialkyldithiophosphates, such as
zinc di-n-propyldithiophosphate,
zinc diisopropyldithiophosphate,
zinc di-n-butyldithiophosphate,
zinc diisobutyldithiophosphate,
zinc di-sec-butyldithiophosphate,
zinc di-n-amyldithiophosphate,
zinc diisoamyldithiophosphate,
zinc di-n-hexyldithiophosphate,
zinc di-sec-hexyldithiophosphate,
zinc bis(2-ethylhexyl)dithiophosphate, and
zinc didecyldithiophosphate,
zinc diaryldithiophosphates, such as
zinc diphenyldithiophosphate, and
zinc bis(alkylaryl)dithiophosphates, such as
zinc bis(octylphenyl)dithiophosphates,
zinc bis(nonylphenyl)dithiophosphates, and
zinc bis(dodecylphenyl)dithiophosphates.

The above-described component (B), i.e. the zinc dithiophosphate is present in the lubricating oil composition of the present invention at a concentration of from 0.05 to 5.0% by weight, preferably from 0.1 to 3.0% by weight. If the percentage of the component (B) is less than 0.05% by weight of the lubricating oil composition, the effect of improving wear resistance and load carrying capacity will be small. On the other hand, even if the percentage of the component (B) exceeds 5.0% by weight of the lubricating oil composition, larger effect cannot be expected.

The unsaturated aliphatic alcohol of from 16 to 24 carbon atoms which is to be used as the component (C) in the lubricating oil composition of the present invention may be any alcohol having the above-described number of carbon atoms and at least one double bond in each molecule. The preferred are alcohols having an iodine number of about not less than 50. Some examples of the preferred unsaturated aliphatic alcohols include cis-11-hexadecene-1-ol ($C_{16}H_{32}O$), cis-9-octadecene-1-ol (oleyl alcohol, $C_{18}H_{36}O$), 3,7,11,15-tetramethyl-2-hexadecene-1-ol ($C_{20}H_{40}O$), 9-eicosene-1-ol ($C_{20}H_{40}O$), 11-docosene-1-ol ($C_{22}H_{44}O$), 13-docosene-1-ol ($C_{22}H_{44}O$), 12-tetracosene-1-ol ($C_{24}H_{48}O$), and 13-tetracosene-1-ol ($C_{24}H_{48}O$).

Among these, the particularly preferred examples include 11-docosene-1-ol, 13-docosene-1-ol, 9-eicosene-1-ol, and cis-9-octadecene-1-ol (oleyl alcohol).

The above-described component (C), i.e. the unsaturated aliphatic alcohol is present in the lubricating oil composition of the present invention at a concentration of from 0.01 to 10% by weight, preferably from 0.05 to 6.0% by weight, and the weight ratio of the unsaturated aliphatic alcohol to the zinc dithiophosphate, (C)/(B), is from 0.1 to 10, preferably from 0.2 to 3.0. If the percentage of the component (C) in the lubricating oil composition is less than 0.01% by weight or (C)/(B) is less than 0.1, the component (C) cannot produce much effect of inhibiting the formation of sludge. On the other hand, even if the percentage of the component (C) exceeds 10% by weight or (C)/(B) exceeds 3.0, larger effect cannot be expected.

The oxidation stability of the lubricating oil composition of the present invention comprising the above-described lubricating base oil (A), the component (B), and the component (C), can be further improved by adding a relatively small amount of at least one detergent-dispersant (component D).

The detergent-dispersant to be used in the present invention may be any known detergent-dispersant, and some examples include metallic detergent-dispersants such as petroleum sulfonates, phosphonates, and phenates, and ashless detergent-dispersants, such as succinic acid derivatives and amine-type detergent-dispersants. Some typical examples of the detergent-dispersants which may be suitably used are Ca sulfonate and Ca phenate. The component (D), i.e. the detergent-dispersant is present in the lubricating oil composition of the present invention preferably at a concentration of from 0.01 to 5.0% by weight, more preferably from 0.1 to 1.5% by weight, furthermore preferably from 0.2 to 1.0% by weight.

The above-described lubricating oil composition of the present invention comprising the lubricating base oil (A), component (B), and component (C) or the lubricating base oil (A), component (B), component (C), and component (D) may further contain a relatively small amount of at least one additive compound (component E) selected from the group consisting of phosphoric esters, phosphorous esters, amine salts of phosphoric esters, and amine salts of phosphorous esters.

Some examples of the phosphoric esters and the phosphorous esters which may be suitably used are the compounds represented by the following general formulas (II) and (III) respectively:

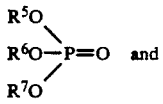

(II)

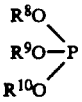

(III)

wherein each of $R^5$, $R^6$, $R^7$, $R^8$, $R^9$, and $R^{10}$ is, for example, independently a hydrogen atom, an alkyl group of from 4 to 30 carbon atoms, an aryl group of from 6 to 30 carbon atoms, or an alkylaryl group of from 7 to 30 carbon atoms, and two or more of them may be identical with each other or they may be different from each other.

Some typical examples of the phosphoric esters and the phosphorous esters include triphenyl phosphate, tricresyl phosphate, trixylenyl phosphate, tris(isopropylphenyl)phosphate, butyl acid phosphate, 2-ethylhexyl acid phosphate, lauryl acid phosphate, oleyl acid phosphate, stearyl acid phosphate, dibutyl hydrogen phosphite, dioctyl hydrogen phosphite, dioleyl hydrogen phosphite, and distearyl hydrogen phosphite.

Some examples of the amine salts of phosphoric esters and the amine esters of phosphorous esters include lauryl amine salt, oleyl amine salt, coconut amine salt, and beef tallow amine salt.

The component (E), i.e. the additive compound is present in the lubricating oil composition of the present invention preferably at a concentration of from 0.01 to 5.0% by weight, more preferably from 0.1 to 1.5% by weight, furthermore preferably from 0.2 to 1.0% by weight. Addition of the component (E) improves wear resistance still more.

Further, the lubricating oil composition of the present invention may contain other additives which has been generally added into lubricating oils, for example, antioxidants, viscosity index improvers, corrosion inhibitors, rust-preventive agents, metal deactivators, or antifoaming agents.

The following Examples are given to illustrate the present invention in more detail. The scope of the invention is not, however, meant to be limited to the specific details of these Examples.

EXAMPLES 1 TO 14 AND COMPARATIVE EXAMPLES 1 TO 5

Table 1 shows the composition and the test results of the lubricating oil compositions of the Examples and Comparative Examples.

The tests made in the Examples and Comparative Examples were carried out by means of the following methods.

(1) Coloration and Discoloration, (2) Property of Inhibiting Formation of Sludge These properties were examined according to JIS K 2540, Method of Testing the Thermostability of Lubricating Oils, at a testing temperature (oil temperature) of 140° C. The catalysts used were copper wire, iron wire, and aluminum wire each being $\phi$ 1.6 mm×8 cm.

Evaluation of the coloration and discoloration (1) was carried out by removing the sample used every 24 hours to observe the color of the sample (ASTM JIS K 2580) and is shown as the time (h) required of the color to exceed the ASTM color grade 4. Evaluation of the property of inhibiting formation of sludge was carried out by observing the above-described sample and was shown as the time (h) required of the deposition of separated material to be observed.

(3) Oxidation Stability

Oxidation stability was examined according to JIS K 2514, paragraph 3.1, Method of Testing the Oxidation Stability of Lubricating Oils for Internal Combustion Engines (so called ISOT).

Conditions of ISOT

The condition for the samples from Example 2 and Comparative Example 1 were @165.5° C.×24 h, and the condition for the sample from Example 12 was @150° C.×96 h.

(4) Wear Resistance (Falex Wear Resistance)

The examination of wear resistance was conducted according to ASTM-D 2670.

| Materials | block | SUJ-2 (Rc62) |
|---|---|---|
| | pin | SKH-1 (Rc65) |

The marks shown in Table 1 have the following meanings.

1: 150 neutral oil (produced by Idemitsu Kosan Co., Ltd.)
2: DOA (Trade-name, dioctyl adipate produced by Nippon Cooper Company)
3: fatty acid esters of trimethylolpropane (Trade-name: Unistar H312R produced by NIPPON OIL & FATS CO., LTD.)
4: 1,2-bis(methlcyclohexyl)-2-methylpropane
5: zinc di-sec-hexyldithiophosphate (Trade-name: LZ677A, produced by Lubrizol Corporation)
6: a mixture of zinc di-($C_4$-$C_6$)-alkyldithiophosphates (Trade-name: OLOA267, produced by Chevron Chemical Company)
7: zinc bis(alkylaryl)dithiophosphate (Trade-name: OLOA260, produced by Chevron Chemical Company)
8: oleyl alcohol (cis-9-octadecene-1-ol)(produced by Kyowa Yushi Co., Ltd.)
9: 85TBN Ca sulfonate+150TBN Ca phenate (1:1 in weight ratio)
10: 300TBN Ca sulfonate+150TBN Ca phenate (1:2 in weight ratio)
11: TCP (tricresyl phosphate) (Trade-name, produced by KYOWA HAKKO KOGYO CO., LTD.)
12: polymethacrylate (number average molecular weight: 60,000) (produced by SANYO CHEMICAL INDUSTRIES, LTD.)
13: silicone oil
14: Kalcohol 20 (Trade-name, produced by Kao Corp.)
15: oleyl oleate (produced by Yuka Sangyo)

TABLE 1

| | | Example | | | | | | |
|---|---|---|---|---|---|---|---|---|
| | | 1 | 2 | 3 | 4 | 5 | 6 | 7 |
| Component (A) (Lubricating base oil) | mineral oil*1 | 99.3 | 99.0 | 98.5 | 99.0 | 99.0 | 98.5 | 97.7 |
| | diester oil*2 | | | | | | | |
| | hindered ester oil*3 | | | | | | | |
| | synthetic naphthene oil*4 | | | | | | | |
| Component (B) | sec-alkylZnDTP*5 | 0.5 | 0.5 | 0.5 | | | | |
| | p-alkylZnDTP*6 | | | | 0.5 | | | |
| | alkylarylAZnDTP*7 | | | | | 0.5 | 1.0 | 1.8 |
| Component (C) | 13-docosene-1-ol | 0.2 | 0.5 | 1.0 | 0.5 | 0.5 | 0.5 | 0.5 |
| | oleyl alcohol*8 | | | | | | | |
| Component (D) | detergent-dispersant*9 | | | | | | | |
| | detergent-dispersant*10 | | | | | | | |
| Component (E) | phosphoric ester*11 | | | | | | | |
| Other additives | viscosity index improver*12 | | | | | | | |
| | antifoaming agent*13 | | | | | | | |

TABLE 1-continued

| | | | | | | | | |
|---|---|---|---|---|---|---|---|---|
| | lauryl alcohol*14 | | | | | | | |
| | oleyl oleate*15 | | | | | | | |
| (1) Coloration and Discoloration (h) | | 120< | 192< | 240 | 456< | 288< | 240< | 120< |
| (2) Property of inhibiting formation of sludge (h) | | 120 | 192 | 264 | 456 | 288 | 240 | 120 |
| (3) Oxidation stability (ISOT) (new oil/test oil) | | | | | | | | |
| viscosity (cSt 40° C.) | | | 36.5/37.8 | | | | | |
| total acid value (mg KOH/g) | | | 0.67/0.63 | | | | | |
| color (ASTM) | | | L 0.5/L 1.5 | | | | | |
| content of matters insoluble in n-pentane (wt %) | | | 0/0.1> | | | | | |
| Zn content in lubricating oil composition (ppm) | | | 427/406 | | | | | |
| (4) Falex abrasion resistance (mg) | | | | | | | | |
| $400^{LBS} \times 60$ min. | block | | 353 | | 376 | | | |
| | pin | | 125 | | 102 | | | |

| | | Example | | | | | | |
|---|---|---|---|---|---|---|---|---|
| | | 8 | 9 | 10 | 11 | 12 | 13 | 14 |
| Component (A) (Lubricating base oil) | mineral oil*1 | 99.0 | 99.0 | 99.0 | 96.8 | | | |
| | diester oil*2 | | | | | | 99.0 | |
| | hindered ester oil*3 | | | | | | | 99.0 |
| | synthetic naphthene oil*4 | | | | | 92.0 | | |
| Component (B) | sec-alkylZnDTP*5 | 0.5 | | | | | 0.5 | 0.5 |
| | p-alkylZnDTP*6 | | 0.5 | | 0.5 | 0.5 | | |
| | alkylarylAZnDTP*7 | | | 0.5 | | | | |
| Component (C) | 13-docosene-1-ol | | | | 0.5 | 0.5 | 0.5 | 0.5 |
| | oleyl alcohol*8 | 0.5 | 0.5 | 0.5 | | | | |
| Component (D) | detergent-dispersant*9 | | | | 0.2 | | | |
| | detergent-dispersant*10 | | | | | 0.5 | | |
| Component (E) | phosphoric ester*11 | | | | | 0.5 | | |
| Other additives | viscosity index improver*12 | | | | 2.0 | 6.0 | | |
| | antifoaming agent*13 | | | | | 0.001 | | |
| | lauryl alcohol*14 | | | | | | | |
| | oleyl oleate*15 | | | | | | | |
| (1) Coloration and Discoloration (h) | | 168< | 384< | 240 | 552 | 528 | 192< | 216 |
| (2) Property of inhibiting formation of sludge (h) | | 168 | 384 | 240 | 600 | 576 | 192 | 216 |
| (3) Oxidation stability (ISOT) (new oil/test oil) | | | | | | | | |
| viscosity (cSt 40° C.) | | | | | | 25.2/27.2 | | |
| total acid value (mg KOH/g) | | | | | | 0.75/0.62 | | |
| color (ASTM) | | | | | | L 0.5/L 2.5 | | |
| content of matters insoluble in n-pentane (wt %) | | | | | | 0/0.1> | | |
| Zn content in lubricating oil composition (ppm) | | | | | | 476/457 | | |
| (4) Falex abrasion resistance (mg) | | | | | | | | |
| $400^{LBS} \times 60$ min. | block | | | | 394 | 34 | | |
| | pin | | | | 128 | 2 | | |

| | | Comparative Example | | | | |
|---|---|---|---|---|---|---|
| | | 1 | 2 | 3 | 4 | 5 |
| Component (A) (Lubricating base oil) | mineral oil*1 | 99.5 | | | 99.0 | 99.0 |
| | diester oil*2 | | 99.5 | | | |
| | hindered ester oil*3 | | | 99.5 | | |
| | synthetic naphthene oil*4 | | | | | |
| Component (B) | sec-alkylZnDTP*5 | 0.5 | 0.5 | 0.5 | 0.5 | 0.5 |
| | p-alkylZnDTP*6 | | | | | |
| | alkylarylAZnDTP*7 | | | | | |
| Component (C) | 13-docosene-1-ol | | | | | |
| | oleyl alcohol*8 | | | | | |
| Component (D) | detergent-dispersant*9 | | | | | |
| | detergent-dispersant*10 | | | | | |
| Component (E) | phosphoric ester*11 | | | | | |
| Other additives | viscosity index improver*12 | | | | | |
| | antifoaming agent*13 | | | | | |
| | lauryl alcohol*14 | | | | 0.5 | |
| | oleyl oleate*15 | | | | | 0.5 |
| (1) Coloration and Discoloration (h) | | 24< | 24< | 24< | 24< | 24< |
| (2) Property of inhibiting formation of sludge (h) | | 24 | 24 | 24 | 24 | 24 |
| (3) Oxidation stability (ISOT) (new oil/test oil) | | | | | | |
| viscosity (cSt 40° C.) | | 37.1/42.0 | | | | |
| total acid value (mg KOH/g) | | 0.67/1.84 | | | | |
| color (ASTM) | | L 0.5/8< | | | | |
| content of matters insoluble in n-pentane (wt %) | | 0/0.43 | | | | |
| Zn content in lubricating oil composition (ppm) | | 431/2 | | | | |
| (4) Falex abrasion resistance (mg) | | | | | | |
| $400^{LBS} \times 60$ min. | block | 374 | | | | |
| | pin | 136 | | | | |

Table 1 shows that the addition of the component (C) such as 13-docosene-1-ol and oleyl alcohol, i.e., in particular, unsaturated aliphatic alcohols of from 18 to 22 carbon atoms improved thermostability and oxidation stability, and particularly, the properties of inhibiting coloration, discoloration, and formation of sludge were remarkably improved. As apparent from Comparative Examples 4 and 5, the compounds other than the components of the present invention could not produce the directed effects.

What is claimed is:

1. A lubricating oil composition, comprising:

(A) a major amount of at least one lubricating base oil;

(B) from 0.05 to 5% by weight of at least one zinc dithiophosphate having a structure represented by the following formula (1)

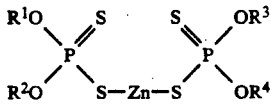

(1)

wherein each of $R^1$, $R^2$, $R^3$, and $R^4$ is independently a primary alkyl group of from 2 to 30 carbon atoms; and (C) from 0.01 to 10% by weight of at least one unsaturated aliphatic alcohol of from 16 to 24 carbon atoms, wherein the weight ratio of the unsaturated aliphatic alcohol to the zinc dithiophosphate, (C)/(B), is from 0.1 to 10.

2. The lubricating oil composition as claimed in claim 1, wherein the lubricating base oil is a mineral oil having a kinematic viscosity of from 5 to 10,000 cSt as measured at 40° C. or a synthetic oil having a kinematic viscosity of from 5 to 10,000 cSt as measured at 40° C.

3. The lubricating oil composition as claimed in claim 1, wherein the zinc dithiophosphate is at least one consisting of zinc di-primary-($C_3$–$C_{12}$)-alkyldithiophosphate.

4. The lubricating oil composition as claimed in claim 1, wherein the unsaturated aliphatic alcohol is 11-docosene-1-ol, 13-docosene-1-ol, 9-eicosene-1-ol or cis-9-octadecene-1-ol.

5. The lubricating oil composition as claimed in claim 4, wherein the unsaturated aliphatic alcohol is 13-docosene-1-ol or cis-9-octadecene-1-ol.

6. The lubricating oil composition as claimed in claim 1, wherein the lubricating base oil is a mineral oil, the zinc dithiophosphate is a mixture of zinc di-primary-($C_4$–$C_6$)-alkyldithiophosphates, and the unsaturated aliphatic alcohol is cis-9-octadecene-1-ol.

7. The lubricating oil composition as claimed in claim 1, further comprising (E) 0.01 to 5% by weight of at least one additive compound selected from the group consisting of phosphoric esters, phosphorous esters, amine salts of phosphoric esters, and amine salts of phosphorous esters.

8. A lubricating oil composition, comprising:

(A) a major amount of at least one lubricating base oil;

(B) from 0.05 to 5% by weight of at least one zinc dithiophosphate having a structure represented by the following formula (1)

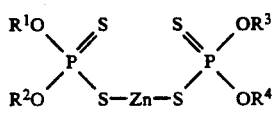

(1)

wherein each of $R^1$, $R^2$, $R^3$, and $R^4$ is independently a primary alkyl group of from 2 to 30 carbon atoms;

(C) from 0.01 to 10% by weight of at least one unsaturated aliphatic alcohol of from 16 to 24 carbon atoms; and (D) 0.01 to 5% by weight of at least one detergent-dispersant, wherein the weight ratio of the unsaturated aliphatic alcohol to the zinc dithiophosphate, (C)/(B), is from 0.1 to 10.

9. The lubricating oil composition as claimed in claim 8, wherein the lubricating base oil is a mineral oil having a kinematic viscosity of from 5 to 10,000 cSt as measured at 40° C. or a synthetic oil having a kinematic viscosity of from 5 to 10,000 cSt as measured at 40° C.

10. The lubricating oil composition as claimed in claim 8, wherein the zinc dithiophosphate is at least one consisting of zinc di-primary-($C_3$-$C_{12}$)-alkyldithiophosphate.

11. The lubricating oil composition as claimed in claim 8, wherein the unsaturated aliphatic alcohol is 11-docosene-1-ol, 13-docosene-1-ol, 9-eicosene-1-ol or cis-9-octadecene-1-ol.

12. The lubricating oil composition as claimed in claim 11, wherein the unsaturated aliphatic alcohol is 13-docosene-1-ol.

13. The lubricating oil composition as claimed in claim 8, wherein the lubricating base oil is a mineral oil, the zinc dithiophosphate is a mixture of zinc di-primary-($C_4$–$C_6$)-alkyldithiophosphates, the unsaturated aliphatic alcohol is 13-docosene-1-ol, and the detergent-dispersant is a mixture of Ca sulfonate and Ca phenate.

14. The lubricating oil composition as claimed in claim 8, further comprising (E) 0.01 to 5% by weight of at least one additive compound selected from the group consisting of phosphoric esters, phosphorous esters, amine salts of phosphoric esters, and amine salts of phosphorous esters.

15. The lubricating oil composition as claimed in claim 14, wherein the lubricating base oil is a mineral oil, the zinc dithiophosphate is a mixture of zinc di-primary-($C_4$–$C_6$)-alkyldithiophosphates, the unsaturated aliphatic alcohol is 13-docosene-1-ol, the detergent-dispersant is a mixture of Ca sulfonate and Ca phenate, and the additive compound is tricresyl phosphate.

16. The lubricating oil composition as claimed in claim 1 wherein the lubricating base oil is a mineral oil having a kinematic viscosity of from 5 to 10,000 cSt as measured at 40° C.; or a synthetic oil having a kinematic viscosity of from 5 to 10,000 cSt as measured at 40° C.;

the zinc dithiophosphate is at least one zinc di-primary-($C_3$–$C_{12}$)-(alkylaryl)dithiophosphate; and the unsaturated aliphatic alcohol is 11-docosene-1-ol, 13-docosene-1-ol, 9-eicosene-1-ol or cis-9-octadecene-1-ol.

17. The lubricating oil composition as claimed in claim 7, wherein the lubricating base oil is a mineral oil having a kinematic viscosity of from 5 to 10,000 cSt as measured at 40° C.; or a synthetic oil having a kinematic viscosity of from 5 to 10,000 cSt as measured at 40° C.;

the zinc dithiophosphate is at least one zinc di-primary-($C_3$–$C_{12}$)-alkyldithiophosphate the unsaturated aliphatic alcohol is selected from the group consisting of 11-docosene-1-ol, 13-docosene-1-ol, 9-eicosene-1-ol or cis-9-octadecene-1-ol; and the additive compound is a phosphoric ester selected from the group consisting of triphenyl phosphate, tricresyl phosphate, trixylenyl phosphate, tris(isopropylphenyl)phosphate, butyl acid phosphate, 2-ethylhexyl acid phosphate, lauryl acid phosphate, oleyl acid phosphate, and stearyl acid phosphate, a phosphorous ester selected from the group consisting of dibutyl hydrogen phosphite, dioctyl hydrogen phosphite, dioleyl hydrogen phosphite and distearyl hydrogen phosphite, an amine salt of said phosphoric ester selected from the group consisting of a lauryl amine salt of the phosphoric ester, an oleyl amine salt of the phosphoric ester, a coconut amine salt of the phosphoric ester, and a beef tallow amine salt of the phosphoric ester, and an amine salt of said phosphorous ester selected from the group consisting of a lauryl amine salt of the phosphorous ester, an oleyl amine salt of the phosphorous ester, a coconut amine salt of the phosphorous ester and a beef tallow amine salt of the phosphorous ester.

18. The lubricating oil composition as claimed in claim 8, wherein the lubricating base oil is a mineral oil having a kinematic viscosity of from 5 to 10,000 cSt as measured at 40° C.; or a synthetic oil having a kinematic viscosity of from 5 to 10,000 cSt as measured at 40° C.;

the zinc dithiophosphate is selected at least one zinc di-primary-($C_3$–$C_{12}$)-alkyldithiophosphate the unsaturated aliphatic alcohol is 11-docosene-1-ol, 13-docosene-1-ol, 9-eicosene-1-ol or cis-9-octadecene-1-ol and the detergent-dispersant is a metallic detergent-dispersant or an ashless detergent-dispersant.

19. The lubricating oil composition as claimed in claim 14, wherein the lubricating base oil is a mineral oil having a kinematic viscosity of from 5 to 10,000 cSt as measured at 40° C.; or a synthetic oil having a kinematic viscosity of from 5 to 10,000 cSt as measured at 40° C.;

the zinc dithiophosphate is selected at least one of zinc di-primary-($C_3$–$C_{12}$)-alkyldithiophostate the unsaturated aliphatic alcohol is selected from the group consisting of 11-docosene-1-ol, 13-docosene-1-ol, 9-eicosene-1-ol or cis-9-octadecene-1-ol;

the detergent-dispersant is a metallic detergent-dispersant or an ashless detergent-dispersant; and the additive compound is a phosphoric ester selected from the group consisting of triphenyl phosphate, tricresyl phosphate, trixylenyl phosphate, tris(isopropylphenyl)phosphate, butyl acid phosphate, 2-ethylhexyl acid phosphate, lauryl acid phosphate, oleyl acid phosphate, and stearyl acid phosphate, a phosphorous ester selected from the group consisting of dibutyl hydrogen phosphite, dioctyl hydrogen phosphite, dioleyl hydrogen phosphite and distearyl hydrogen phosphite, an amine salt of said phosphoric ester selected from the group consisting of a lauryl amine salt of the phosphoric ester, an oleyl amine salt of the phosphoric ester, a coconut amine salt of the phosphoric ester, and a beef tallow amine salt of the phosphoric ester, and an amine salt of said phosphorous ester selected from the group consisting of a lauryl amine salt of the phosphorous ester, an oleyl amine salt of the phosphorous ester, a coconut amine salt of the phosphorous ester and a beef tallow amine salt of the phosphorous ester.

20. The lubricating oil composition as claimed in claim 1, wherein the unsaturated aliphatic alcohol is an unsaturated aliphatic alcohol of from 22 to 24 carbon atoms.

21. The lubricating oil composition as claimed in claim 8, wherein the unsaturated aliphatic alcohol is an unsaturated aliphatic alcohol of from 22 to 24 carbon atoms.

* * * * *